US006220837B1

(12) United States Patent
Naylor

(10) Patent No.: US 6,220,837 B1
(45) Date of Patent: Apr. 24, 2001

(54) PROGRESSING CAVITY PUMP HAVING A RATIO OF ECCENTRICITY, ROTOR DIAMETER AND STATOR LEAD

(75) Inventor: Roger Lawton Naylor, Mount Martha (AU)

(73) Assignee: Mono Pumps Limited, Manchester (GB)

( * ) Notice: Subject to any disclaimer, the term of this patent is extended or adjusted under 35 U.S.C. 154(b) by 0 days.

(21) Appl. No.: 09/387,385

(22) Filed: Sep. 2, 1999

(30) Foreign Application Priority Data

Sep. 9, 1998 (GB) ..... 9819652

(51) Int. Cl.[7] ..... F04C 2/107; F04C 13/00

(52) U.S. Cl. ..... 418/1; 418/48; 418/150; 366/40

(58) Field of Search ..... 418/48, 150, 1; 366/40

(56) References Cited

U.S. PATENT DOCUMENTS

| | | | | |
|---|---|---|---|---|
| 2,636,834 | * | 4/1953 | Myers | 418/48 |
| 3,380,391 | * | 4/1968 | John | 418/48 |
| 3,503,343 | * | 3/1970 | Jackel | 418/48 |
| 4,104,009 | | 8/1978 | Chanton | 418/48 |
| 4,325,682 | * | 4/1982 | Willis | 418/48 |
| 4,591,322 | | 5/1986 | Ono et al. | 418/48 |
| 4,614,146 | * | 9/1986 | Ross et al. | 366/40 |
| 5,318,416 | | 6/1994 | Hantschk et al. | 418/48 |

FOREIGN PATENT DOCUMENTS

| | | |
|---|---|---|
| 0 381 413 | 8/1990 | (EP) . |
| 2 343 906 | 10/1977 | (FR) . |
| 2 557 642 | 7/1985 | (FR) . |

* cited by examiner

*Primary Examiner*—John J. Vrablik
(74) *Attorney, Agent, or Firm*—Harness, Dickey & Pierce, P.L.C.

(57) ABSTRACT

A progressing cavity pump adapted for use in pumping liquid/solid mixtures with a solid content of about 50% has a single start helical rotor and a two start helical stator bore. The ratio of the eccentricity of the rotor to its minor diameter is about 1:4.9. The ratio of the eccentricity of the rotor to the stator lead is about 1:13.3. The pump may be truck mounted and used for pumping explosives.

6 Claims, 4 Drawing Sheets

PROGRESSING CAVITY PUMP HAVING A RATIO OF ECCENTRICITY, ROTOR DIAMETER AND STATOR LEAD

BACKGROUND OF THE INVENTION

1. Field of the Invention

The present invention relates to progressing cavity pumps and particularly to such pumps suitable for pumping liquid/solid mixtures having a high proportion of relatively incompressible solids.

2. Description of the Prior Art

In, for example, mining applications it is necessary to pump explosive mixtures having liquid and solid components from a truck carrying bulk supplies of the components to pre-drilled holes in the rock to be quarried or mined. Normally the solids content of the mixture is about 35–40% of the total, the remainder being liquid. It is desirable from a cost point of view to reduce the liquid content so that the mixture is about 50% solids. However, existing progressing cavity pumps have excessive power requirements when pumping mixtures of such high solids content and are prone to entrapment of solid material and stalling. Examples of such pumps have been described in U.S. Pat. No. 4,773,834, U.S. pat. No. 4,591,322, GB 1,542,786 and GB-A2,228,976.

BRIEF SUMMARY OF THE INVENTION

It is an object of the invention to provide a progressing cavity pumps capable of pumping mixtures having a relatively high proportion of entrained solids.

According to the present invention there is provided a progressing cavity pump comprising a stator having a bore therethrough formed with a female, two start, helical gear formation of a given pitch. A cooperating rotor formed with a male, single start, helical gear formation of the same pitch and a drive arrangement for causing the rotor to rotate and orbit relative to the stator are provided. The ratio of the eccentricity, e, of the gear formation of the rotor to its minor diameter, d, is in the range of between 1 to 4.6 and 1 to 5.2 and the ratio of the eccentricity, e, of the gear formation of the rotor to stator lead, $p_s$, is in the range of between 1 to 11 and 1 to 15.

Preferably, the ratio of the eccentricity (e) of the rotor gear to its minor diameter (d) is in the range of from 1:4.8 to 1:5.0 and the ratio of the eccentricity (e) of the rotor gear to the stator lead ($p_s$) is in the range of from 1:13 to 1:13.6. Ideally the ratio e:d is about 1:4.9 and the ratio e:$p_s$, is about 1:13.3.

Pumps according to the present invention are able to pump liquid/solid mixtures with a solids content of about 50% with a reduced power requirement and a reduced risk of entrapment of solid material.

BRIEF DESCRIPTION OF THE DRAWINGS

Exemplary embodiments of the invention will be described below with reference to the accompanying drawings, in which.

In the Figures, like parts are identified by like reference numerals.

DESCRIPTION OF THE PREFERRED EMBODIMENTS

Figure 1:
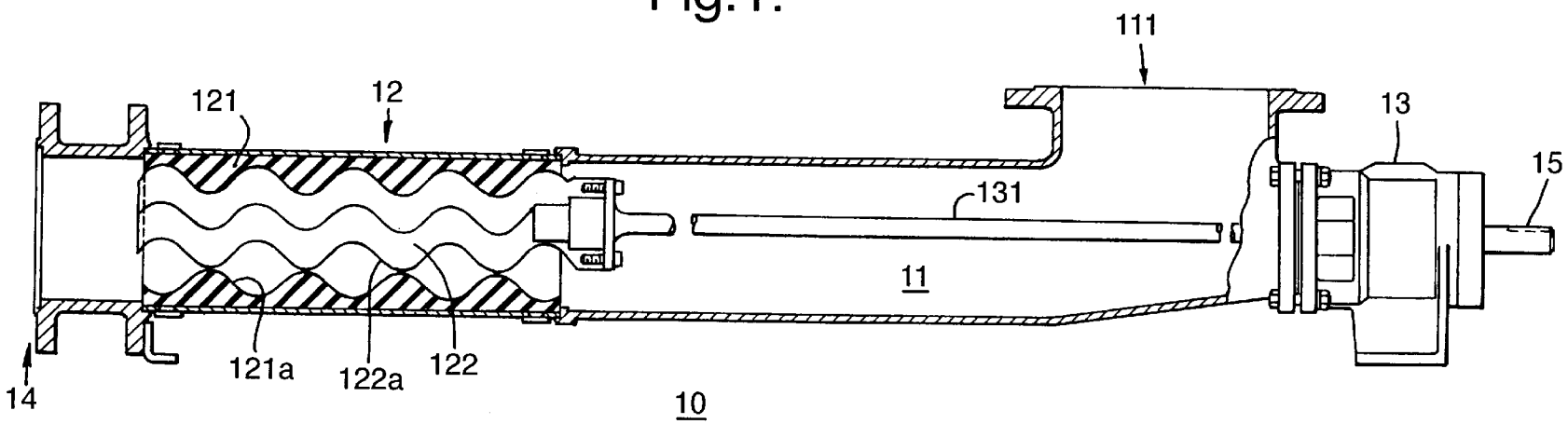
FIG. 1 is a part-sectional view of a progressing cavity pump according to a first embodiment of the present invention.

FIG. 1 shows a first presently preferred embodiment of a progressing cavity pump 10 embodying the present invention. The pump 10 has, as its major components, inlet chamber 11, pumping section 12, drive section 13 and discharge section 14. It is driven by via input shaft 15.

The inlet chamber 11 has an inlet 111 for the mixture to be pumped and will have suitable fittings for direct connection to a reservoir of the mixture or appropriate supply conduits.

Pumping section 12 comprises a stator 121 and rotor 122. The stator 121 is a cylinder of compliant material, e.g. rubber, with an axial bore having a female, two start, helical gear surface 121*a*. The rotor 122 is an elongate rod with its outer surface machined to form a male, one start, helical gear 122*a* corresponding to the female gear surface 121 a of the stator. The rotor may be made from stainless steel or carbon steel coated in hard chromium. The helical gear surfaces 121*a* and 122*a* have the same pitch but the stator gear surface 121*a* has twice the eccentricity as the rotor gear surface 122*a*. As the female gear 121*a* on the stator has two starts, its lead, $p_s$, is twice the lead, $p_r$ of the male gear 122*a* on the rotor.

Drive from the input shaft 15, which may be via a hydraulic motor of known type, is transmitted to the rotor 122 of the pumping section 12. The rotor 122 is driven to rotate and is caused to orbit by the interaction of the male and female gears. The orbiting motion is permitted by the elongate drive shaft 131 which has a certain degree of flexibility. The rotation and orbiting of the rotor relative to the stator causes cavities formed between the gears to progress from the inlet chamber 11 to the output 14.

Figure 2A:
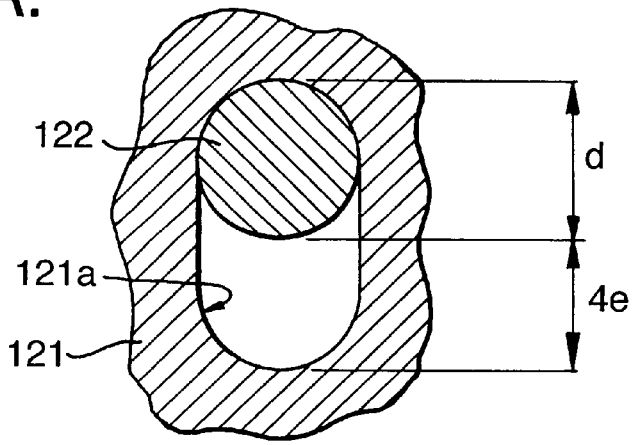
FIGS. 2A, B and C are sketches illustrating the parameters e, d and p.

FIGS. 2A, B and C show the configuration of the stator and rotor. FIG. 2A is a sketched partial cross-section of the rotor and stator. As shown, the rotor is circular in cross-section with a minor diameter, d. The bore in the stator is track shaped, i.e. has two semicircular ends joined by straight sides, in cross-section. Its long axis diameter is equal to the minor diameter of the rotor plus four times tile eccentricity.

Figure 2B:
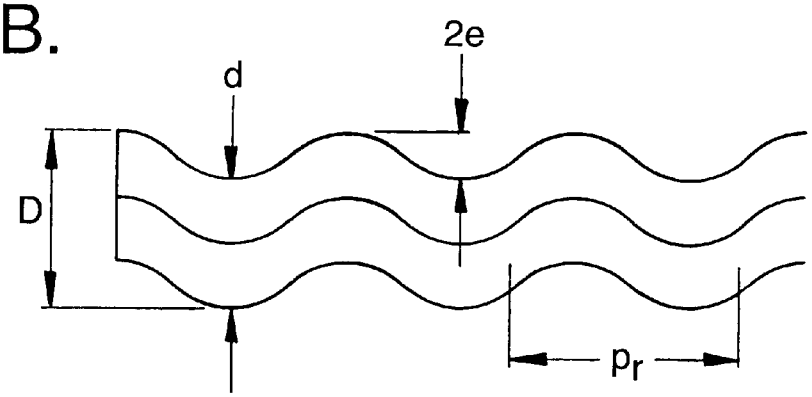

FIG. 2B is a sketch of part of the rotor. As shown, the major diameter, D, of the rotor is equal to the minor diameter, d, plus twice the eccentricity, e. The pitch of the rotor, as shown, is equal to the lead, $p_r$.

Figure 2C:
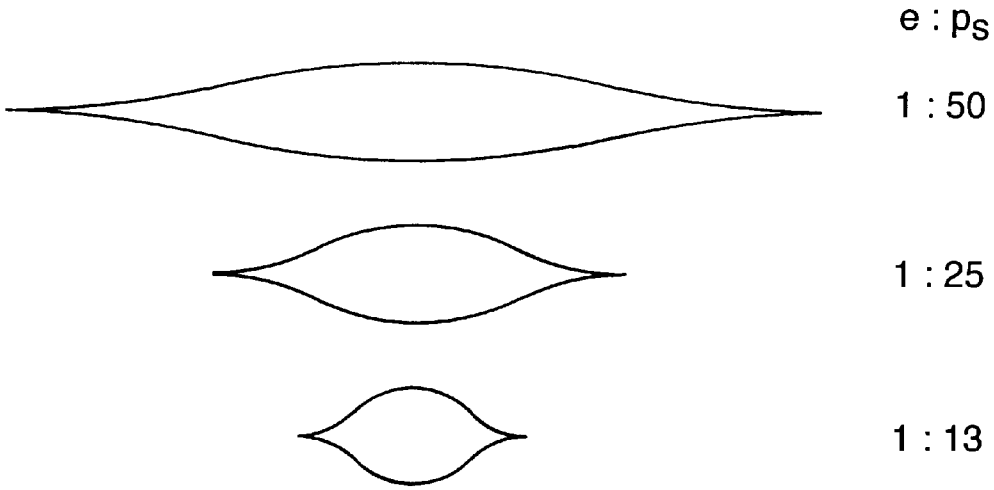

FIG. 2C is a sketch of capsulism profiles of progressing cavity pumps for different values of the ratio of eccentricity, e, to the stator lead, $p_s$. Whilst typical progressing cavity pumps have a ratio of e:$p_s$ of between 1:25 and 1:50, in this embodiment of the present invention the ratio of eccentricity, e, to minor diameter of the rotor, d, is 1:4.9 and the ratio of eccentricity, e, to stator lead, $p_s$, is 1:13.3. The pump may therefore be described as having a 1:4.9:13.3 ratio.

Figure 3:
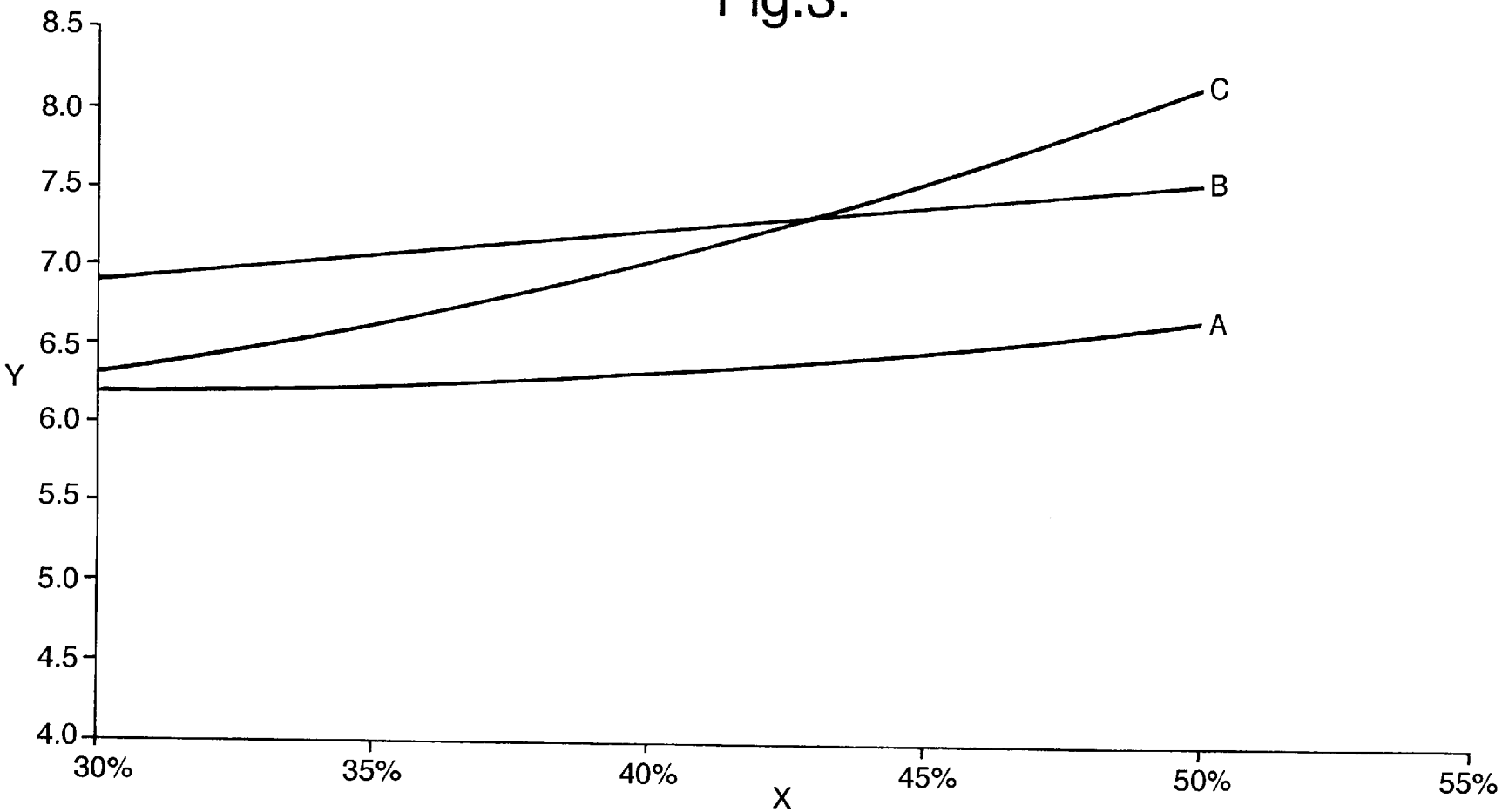
FIG. 3 is a graph illustrating power requirement vs. solids ratio of the first embodiment of the invention and two known pumps

FIG. 3 is a graph showing power consumption in kilowatts on axis Y vs. solids content of the pumped fluid on axis X. Line A is the pump of FIG. 1 and lines B and C are prior art pumps of ratios 1:5:26 and 1:6:27 respectively. As can be seen the pump of the present invention uses 12% less power than pump B and nearly 20% less than pump C.

The described embodiment of the invention has two stages but pumps of more or fewer stages may also be constructed with the same geometry.

The embodiment of FIG. 1 is adapted to be mounted on a vehicle, such as a truck bearing reservoirs of explosive components to be mixed prior to pumping.

Figure 4:
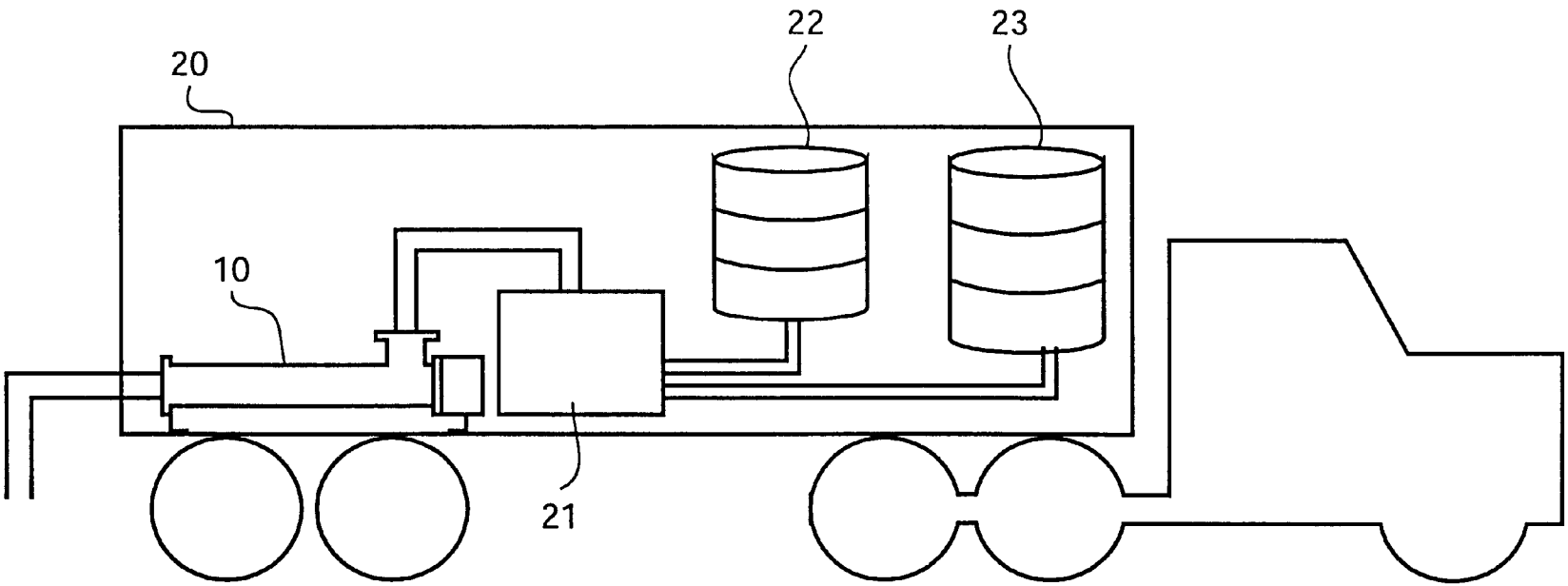
FIG. 4 is a schematic view of a vehicle on which a progressing cavity pump according to the invention is mounted.

FIG. 4 shows a truck 20 having mounted a progressing cavity pump 10 as well as a mixer 21 for mixing explosive components from reservoirs 22, 23.

I claim:

1. A progressing cavity pump comprising a stator having a bore therethrough formed with a female, two start, helical gear formation having a given pitch and lead, a cooperating rotor formed with a male, single start, helical gear formation having the same given pitch, an eccentricity and a minor diameter and a drive arrangement for causing said rotor to rotate and orbit relative to said stator, wherein the ratio of the eccentricity, e, of the gear formation of the rotor to its minor diameter, d, is in the range of between 1 to 4.6 and 1 to 5.2 and wherein the ratio of the eccentricity, e, of the gear formation of the rotor to stator lead, $p_s$, is in the range of between 1 to 11 and 1 to 15.

2. A pump according to claim 1 wherein said ratio e: d is in the range of between 1 to 4.8 and 1 to 5.0 and said ratio e: $p_s$, is in the range of between 1 to 13 and 1 to 13.6.

3. A pump according to claim 1 wherein said ratio e: d is about 1:4.9 and said ratio e: $p_s$, is about 13.3.

4. A method of pumping explosive mixtures having liquid and solid components comprising the step of using a progressing cavity pump according to claim 1.

5. A method according to claim 4 wherein said mixture has a total solids content of greater than 45% by volume.

6. A vehicle having mounted thereon reservoirs for storing components of an explosive mixture, a mixer for mixing said components and a progressing cavity pump according to claim 1 for pumping the mixed components.

* * * * *

UNITED STATES PATENT AND TRADEMARK OFFICE

CERTIFICATE OF CORRECTION

PATENT NO. : 6,220,837 B1
DATED : April 24, 2001
INVENTOR(S) : Roger Lawton Naylor It is certified that error appears in the above-identified patent and that said Letters Patent is hereby corrected as shown below:

Column 2,
Line 44, "tile" should be -- the --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*